US005810559A

United States Patent [19]

Dixon et al.

[11] Patent Number: 5,810,559

[45] Date of Patent: Sep. 22, 1998

[54] REACTOR COOLANT PUMP SAFETY SHROUD

[75] Inventors: Larry D. Dixon; Ronald J. Payne, both of Forest; William H. Stafford, II, Lynchburg, all of Va.

[73] Assignee: Framatome Technologies, Inc., Lynchburg, Va.

[21] Appl. No.: 993,836

[22] Filed: Dec. 18, 1997

[51] Int. Cl.[6] ..... F01D 25/00; F03B 11/00

[52] U.S. Cl. ..... 415/216.1; 416/204 R; 416/213 R; 416/244 R

[58] Field of Search ..... 416/204 R, 244 R, 416/244 A, 244 B, 245 R, 245 A; 415/216.1

[56] References Cited

U.S. PATENT DOCUMENTS 3,342,273 9/1967 Crane ..... 416/204

5,417,093 5/1995 Heiberg ..... 416/244 B X

FOREIGN PATENT DOCUMENTS 614103 5/1935 Germany ..... 416/244 R

*Primary Examiner*—John E. Ryznic

*Attorney, Agent, or Firm*—Rhodes Coats & Bennett, L.L.P.

[57] ABSTRACT

A safety shroud of a nuclear reactor coolant pump. Capscrew heads, if broken, are prevented from separating from a nuclear reactor coolant pump having a drive shaft, an impeller secured to the drive shaft, a suction deflector secured to the impeller, and capscrews with outer heads securing the impeller and suction deflector to the drive shaft, by securing a safety shroud over the capscrew heads. The safety shroud may be secured by welding the safety shroud to the impeller or suction deflector, or by bolting the safety shroud to the distal end of the drive shaft.

19 Claims, 3 Drawing Sheets

REACTOR COOLANT PUMP SAFETY SHROUD

BACKGROUND OF THE INVENTION (1) Field of the Invention

The present invention relates generally to nuclear reactor coolant pumps and, more particularly to a method and apparatus for modifying a reactor coolant pump to reduce the risk of damage to the pump and other parts of the reactor in the event of breakage of the capscrews used to secure the pump impeller and suction deflector to the pump drive shaft.

(2) Description of the Prior Art

The internals of reactor coolant pumps used to circulate coolant in a nuclear reactor are generally located in areas that can only be accessed using remote instrumentation through the reactor coolant system piping. Access to these areas is very limited and requires closing and fully disassembling the pump which can be extremely expensive.

The present invention is especially applicable to the "Byron Jackson" type of pump, which is comprised of a motor driven drive shaft, an impeller at the distal end of the drive shaft, and an annular suction deflector on the exterior surface of the impeller axially aligned with the drive shaft. The impeller and suction deflector are secured to the distal end of the shaft, or a collar around the shaft, with a plurality of bolts or capscrews.

There is a concern that the originally installed capscrews may break over time when subjected to the pump vibrations, flow pressures, water temperatures, fluid chemistry, etc. Breakage of the capscrews and loss into the other parts of the core, plus the possible detachment of the impeller and suction deflector, could cause considerable damage to the pump and core.

Therefore, it has been necessary as a preemptive measure to replace these capscrews with stronger capscrews. Capscrew replacement first requires closing down of the reactor and removal of the reactor coolant pump motor, interferences, and electrical/mechanical connections. The pump is then disassembled, the existing deflector is removed, the capscrews are replaced with upgraded capscrews, and the pump is reassembled. This time-consuming repair has resulted in considerable cost and inconvenience.

Thus, there remains a need for a method and apparatus for repairing Byron Jackson type pumps, and pumps of similar construction while, at the same time, reducing costly disassembly.

SUMMARY OF THE INVENTION

The present invention is directed to a method and apparatus for repairing reactor coolant pumps, and to the resulting modified pump. The invention is relates especially to a method and apparatus for remotely modifying such pumps without the need to disassemble the pump and undertake the time consuming and costly bolt replacement steps heretofore required.

The reactor coolant pumps addressed by the present invention are comprised of a casing having coolant inlets and outlets, and an impeller at the distal end of a motor driven drive shaft. Rotation of the drive shaft rotates the impeller and moves water between the inlet and outlet. The pump also includes a suction deflector secured to the exterior of the impeller in the direction of the inlet to promote non-turbulent flow. Capscrews extend through the suction deflector and impeller, and into recesses in a collar around the distal end of the drive shaft to secure the deflector and impeller in position.

Instead of undertaking costly procedures requiring pump disassembly, it has been found that the potential risks associated with breakage of one or more of the capscrews can be reduced by the simple expedient of securing a covering or safety shroud over the suction deflection and capscrew heads, and to the impeller or pump shaft to "catch" the capscrew head if it separates from the bolt body. In addition, with this solution, attachment of the safety shroud can be made using remote tools carried to the pump through the steam generator manway, resulting in a considerable reduction in costs.

The safety shroud is preferably designed with an annular outer section that has inner and outer peripheral edges, and interior and exterior surfaces corresponding to the exterior surface of the suction deflector. With this configuration, the interior concave surface of the safety shroud will mate with the convex exterior surface of the suction deflector to provide secure seating, and the exterior convex surface of the safety shroud will produce the same water flow pattern as that provided by the suction deflector. The central portion of the safety shroud may be open, or a plate or seat may extend across the safety shroud central portion to join the inner periphery of the annular section.

The safety shroud may be secured over the suction deflector and the capscrew heads by welding the safety shroud to the impeller, or by bolting the safety shroud to the end of the drive shaft.

When welded, the safety shroud inner or outer periphery, or both, may be welded directly to the impeller. Alternatively, the safety shroud may be welded to the suction deflector, and the suction deflector welded to the impeller.

Some pumps, such as the Byron Jackson pumps of primary interest in the present invention, already include a threaded recess extending axially into the distal end of the drive shaft, which was originally intended for the purpose of balancing the drive shaft. It has been found that the safety shroud can be secured to the pump drive shaft by extending a bolt through the safety shroud and into this threaded recess. The bolt can extend through a central opening in the safety shroud central plate. Also, a part of the safety shroud, such as a sleeve extending outwardly from around the central opening, can be welded or crimped to the bolt to prevent rotation of the safety shroud.

Accordingly, one aspect of the present invention is to provide an improved reactor coolant pump. The pump includes: (a) a drive shaft; (b) an impeller adapted to be secured to the drive shaft; (c) capscrews with outer heads securing the impeller to the drive shaft; and (d) a safety shroud secured over the capscrew heads, whereby the capscrew heads are retained by the safety shroud in the event the capscrews break.

Another aspect of the present invention is to provide a safety shroud for a reactor coolant pump having a drive shaft, an impeller secured to the drive shaft, a suction deflector attached to the impeller and capscrews with outer heads securing the impeller and the suction deflector to the drive shaft. The safety shroud includes: (a) an annular section; (b) a convex exterior surface; (c) a concave interior surface, the convex exterior surface and the concave interior surface substantially conforming to the profile of the suction deflector such that the safety shroud nests with the suction deflector and extends over the capscrew heads, whereby the capscrew heads are retained by the safety shroud in the event the capscrews break.

Still another aspect of the present invention is to provide an improved reactor coolant pump. The pump includes: (a) a drive shaft; (b) an impeller adapted to be secured to the drive shaft; (c) a suction deflector; (d) capscrews with outer heads securing the impeller and the suction deflector to the drive shaft; and (e) a safety shroud secured over the capscrew heads, the safety shroud including: (i) an annular section; (ii) a convex exterior surface; (iii) a concave interior surface, the convex exterior surface and the concave interior surface substantially conforming to the profile of the suction deflector such that the safety shroud nests with the suction deflector and extends over the capscrew heads, whereby the capscrew heads are retained by the safety shroud in the event the capscrews break.

These and other aspects of the present invention will become apparent to those skilled in the art after a reading of the following description of the preferred embodiment when considered with the drawings.

DESCRIPTION OF THE PREFERRED EMBODIMENTS

Figure 1:
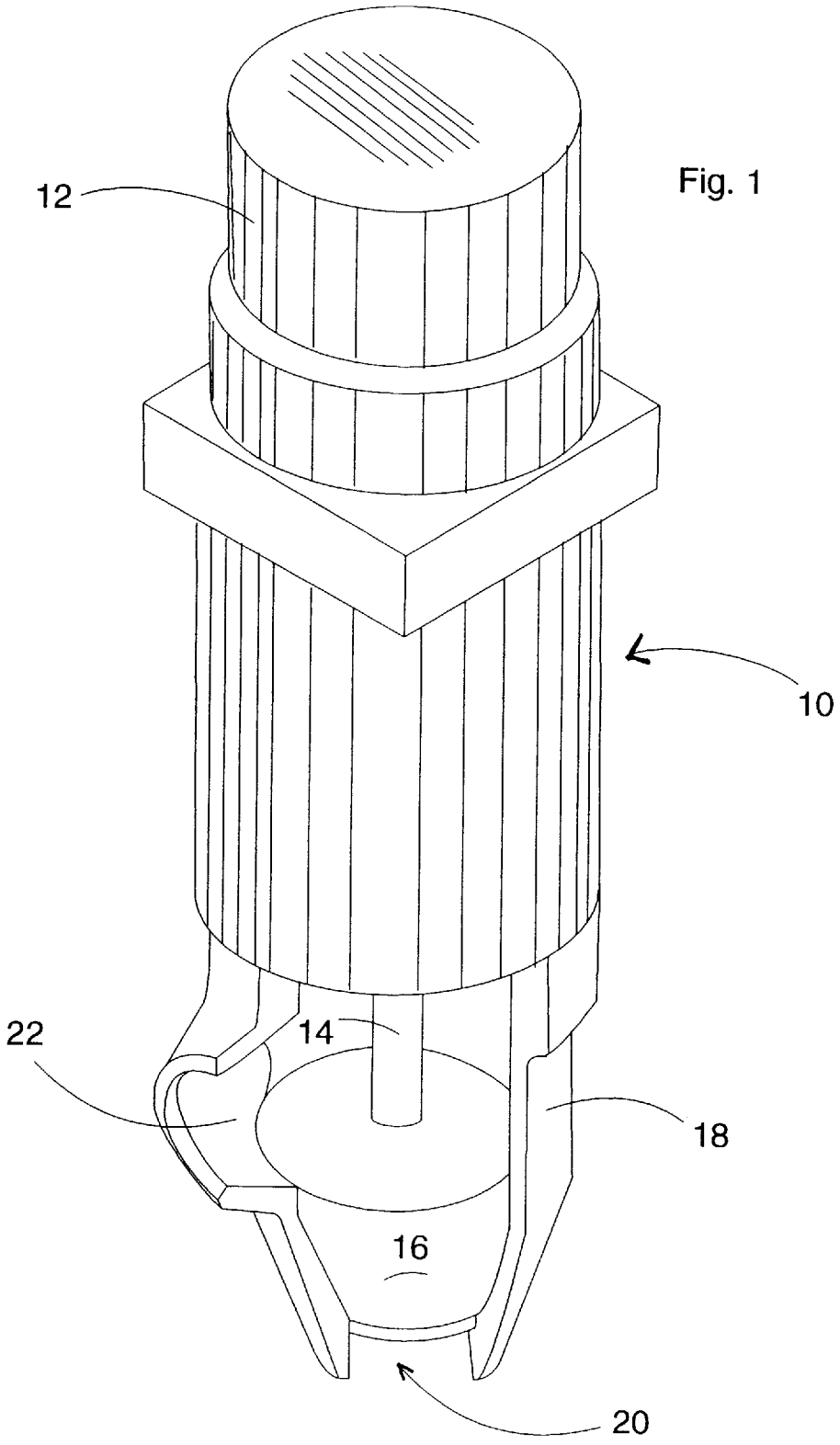
FIG. 1 is a perspective view of a typical reactor cooling pump which could benefit from a repair using a safety shroud constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a typical reactor cooling pump, generally designated 10, is comprised of a motor 12 with a vertical drive shaft 14. The distal end of shaft 14 is attached to an impeller 16. Impeller 16 is located within a casing 18 that includes an inlet 20 and an outlet 22. Cooling water is pumped to steam generators by rotating drive shaft 14 with motor 12 to rotate attached impeller 16, conveying water in through inlet 20 and out through outlet 22.

Figure 2:
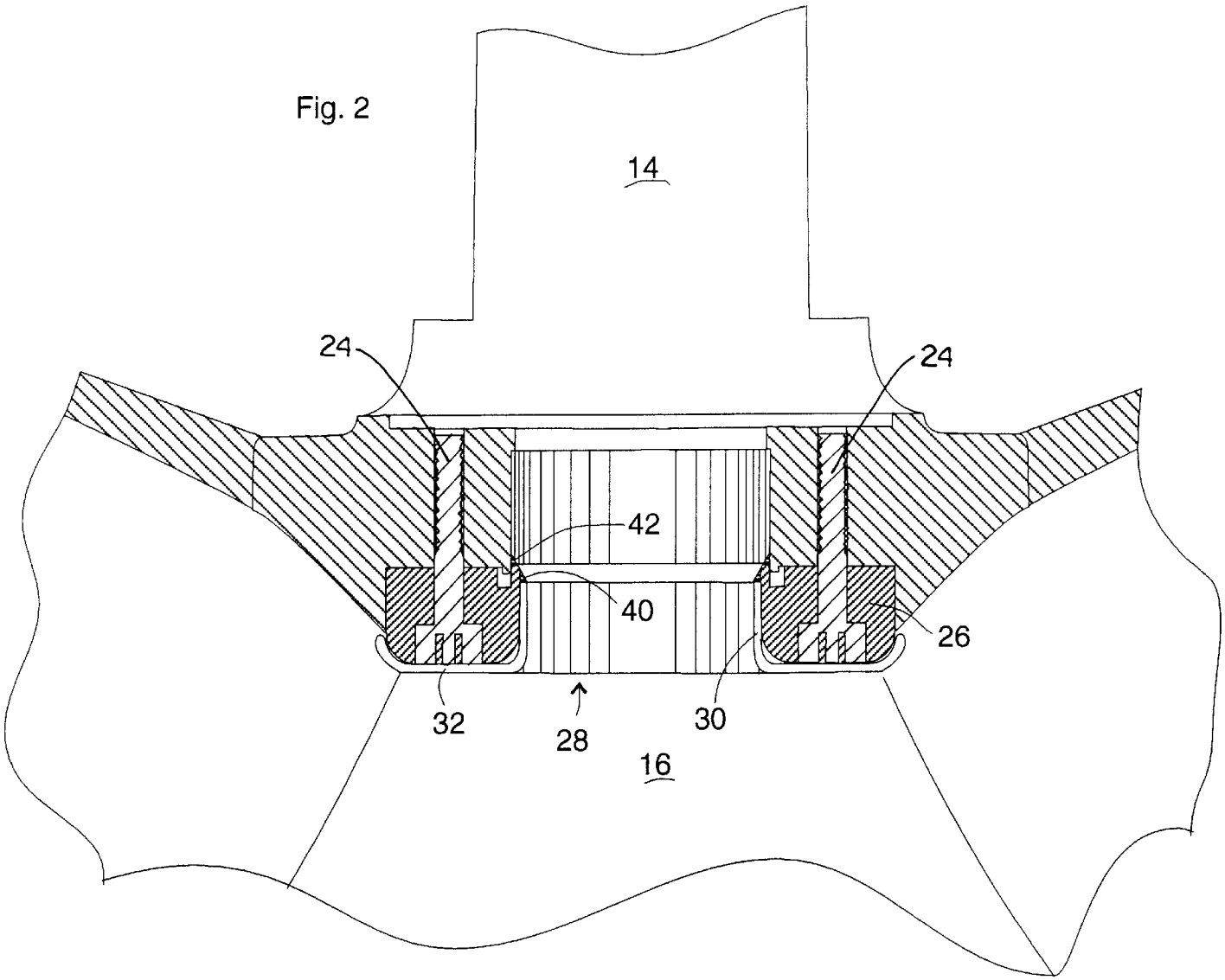
FIG. 2 is a sectional side view of the impeller and drive shaft, illustrating the safety shroud of the present invention welded over the suction deflector.
Figure 3:
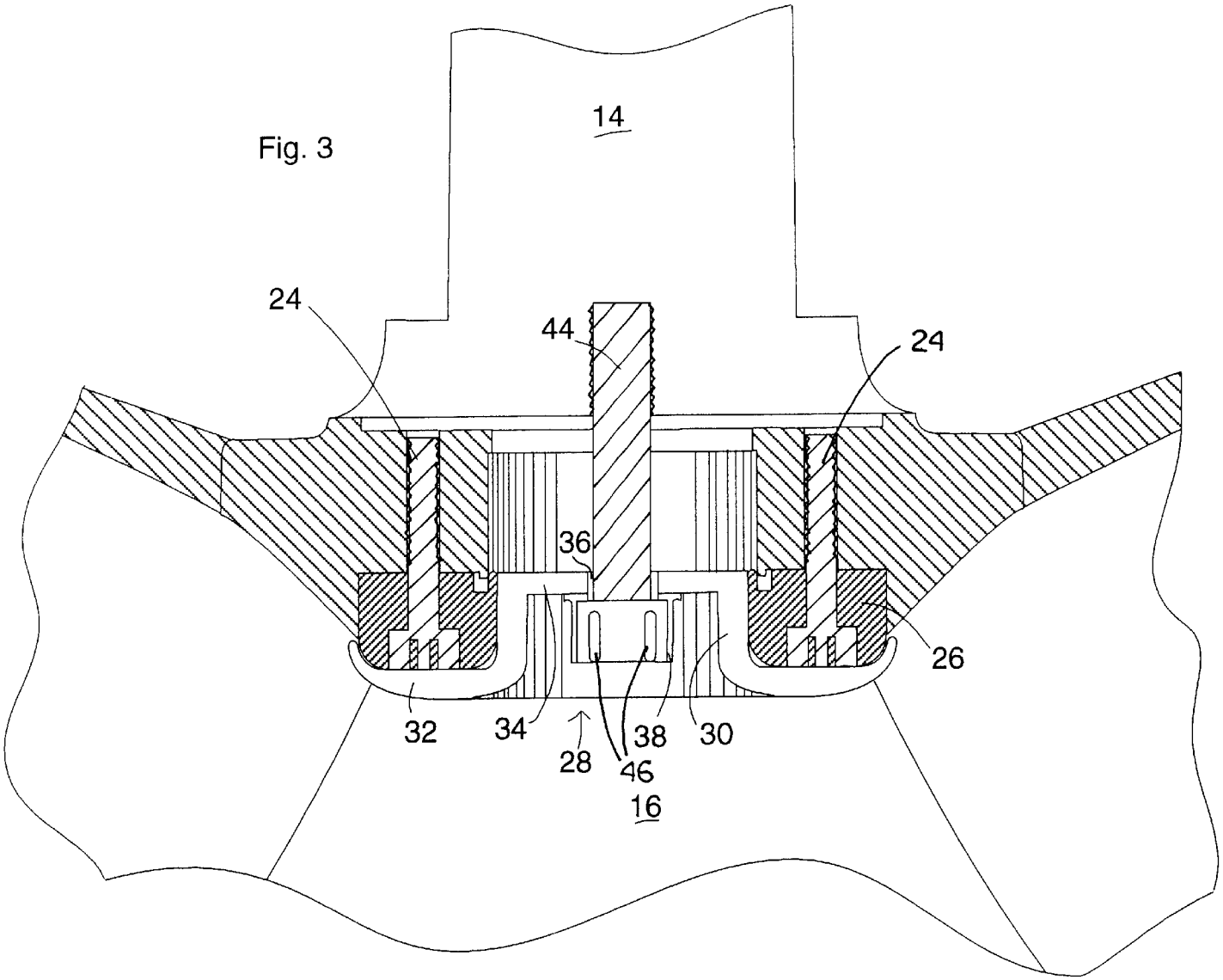
FIG. 3 is a sectional side view of the impeller and drive shaft, illustrating the safety shroud of the present invention bolted to the end of the drive shaft.

As best shown in FIGS. 2 and 3, impeller 16 is secured to the distal end of drive shaft 14 with a plurality of capscrews 24. A suction deflector 26, used to reduce turbulence, is also positioned at the end of drive shaft 14 and is secured to impeller 16 with capscrews 24.

During operation over a period of time, there is some concern that capscrews 24 may break due to stress corrosion cracking resulting in the head of the screw separating from the bolt body and being free to cause damage to moving parts. Instead of replacing the capscrews as earlier described, the present invention addresses this concern by securing a protective cap or safety shroud 28 over the exterior of suction deflector 26 and the outer ends of capscrews 24 to "catch" a possible loose head.

Safety shroud 28 is comprised of a generally cylindrical inner section 30, with a lower peripheral edge and an upper peripheral edge; and a ring-shaped annular section 32, having an inner peripheral edge integral with the upper peripheral edge of section 30, and an outer peripheral edge. Section 32 has a convex outer surface generally corresponding to the exterior surface of suction deflector 26, so that the flow pattern of the pump will not be altered; an interior concave surface generally corresponding to the exterior surface of suction deflector 26, so that safety shroud 28 can be firmly secured to deflector 26.

In addition, as shown in FIG. 3, safety shroud 28 may include a plate 34 across the inner periphery of section 30. Plate 34 includes a central bolt receiving opening 36, and may also include a deformable sleeve 38. In the preferred embodiment, safety shroud 28 is formed of a non-corrosive metal or other material.

In the embodiment shown in FIG. 2, safety shroud 28 is secured to suction deflector 26 with weld 40. Suction deflector 26, in turn, is secured to impeller 16 by weld 42. In the alternative embodiment shown in FIG. 3, safety shroud 28 is bolted to the end of drive shaft 14 with bolt 44, which extends through opening 36. Deformable sleeve 38 is crimped into flutes 46 on the exterior of bolt 44 to prevent rotation of safety shroud 28.

Certain modifications and improvements will occur to those skilled in the art upon a reading of the foregoing description. By way of example, safety shroud 28 can be welded directly to impeller 16. Also, the safety shroud can be used with pumps other than as illustrated in the preferred embodiment. It should be understood that all such modifications and improvements have been deleted herein for the sake of conciseness and readability but are properly within the scope of the following claims.

We claim:

1. An improved reactor coolant pump, said pump comprising:

(a) a drive shaft;

(b) an impeller adapted to be secured to the drive shaft;

(c) capscrews with outer heads securing said impeller to said drive shaft; and (d) a safety shroud secured over said capscrew heads, whereby said capscrew heads are retained by said safety shroud in the event said capscrews break.

2. The apparatus according to claim 1, further including a suction deflector attached to said impeller by said capscrews between said impeller and said safety shroud.

3. The apparatus according to claim 2, wherein said safety shroud is welded to said impeller.

4. The apparatus according to claim 3, wherein said safety shroud is further welded to said suction deflector.

5. The apparatus according to claim 1, said safety shroud is secured directly to said drive shaft.

6. The apparatus according to claim 5, wherein the distal end of said drive shaft includes a threaded bolt hole for receiving a bolt to secure said safety shroud to said drive shaft distal end.

7. A safety shroud for a reactor coolant pump having a drive shaft, an impeller secured to the drive shaft, a suction deflector attached to said impeller and capscrews with outer heads securing said impeller and said suction deflector to said drive shaft, said safety shroud comprising:

(a) an annular section;

(b) a convex exterior surface;

(c) a concave interior surface, said convex exterior surface and said concave interior surface substantially conforming to the profile of said suction deflector such that said safety shroud nests with said suction deflector and extends over said capscrew heads, whereby said capscrew heads are retained by said safety shroud in the event said capscrews break.

8. The apparatus according to claim 7, wherein said safety shroud includes a central plate with a bolt receiving opening, and a deformable bolt engaging sleeve extending outwardly from around said bolt receiving opening, whereby said safety shroud may be directly attached to the distal end of said drive shaft.

9. An improved reactor coolant pump, said pump comprising:

(a) a drive shaft;

(b) an impeller adapted to be secured to the drive shaft;

(c) a suction deflector;

(d) capscrews with outer heads securing said impeller and said suction deflector to said drive shaft; and (e) a safety shroud secured over said capscrew heads, said safety shroud including: (i) an annular section; (ii) a convex exterior surface; (iii) a concave interior surface, said convex exterior surface and said concave interior surface substantially conforming to the profile of said suction deflector such that said safety shroud nests with said suction deflector and extends over said capscrew heads, whereby said capscrew heads are retained by said safety shroud in the event said capscrews break.

10. The apparatus according to claim 9, wherein said safety shroud is welded to said impeller.

11. The apparatus according to claim 10, wherein said safety shroud is further welded to said suction deflector.

12. The apparatus according to claim 9, said safety shroud is secured directly to said drive shaft.

13. The apparatus according to claim 12, wherein the distal end of said drive shaft includes a threaded bolt hole for receiving a bolt to secure said safety shroud to said drive shaft distal end.

14. The apparatus according to claim 9, wherein said safety shroud includes a central plate with a bolt receiving opening, and a deformable bolt engaging sleeve extending outwardly from around said bolt receiving opening, whereby said safety shroud may be directly attached to the distal end of said drive shaft.

15. A method of preventing separation of broken capscrew heads from a reactor coolant pump, said method comprising the steps of:

(a) providing a nuclear reactor coolant pump including a drive shaft, an impeller secured to the drive shaft, and capscrews with outer heads securing said impeller to said drive shaft: and (b) securing a safety shroud over said capscrew heads to retain said heads in event of breakage.

16. The method according to claim 15, wherein said reactor coolant pump further includes a suction deflector attached to said impeller by said capscrews, and said safety shroud is secured over said deflector and said capscrew heads.

17. The method according to claim 15, wherein said safety shroud is bolted to said drive shaft.

18. The method according to claim 15, wherein said safety shroud is secured by welding.

19. The method according to claim 15, wherein said safety shroud includes an annular convex outer section.

* * * * *